US008142043B2

(12) United States Patent
Hsu et al.

(10) Patent No.: US 8,142,043 B2
(45) Date of Patent: Mar. 27, 2012

(54) PLANAR LIGHT SOURCE APPARATUS HAVING REFLECTIVE SURFACES

(75) Inventors: Chih-Peng Hsu, HsinChu (TW); Chung-Min Chang, HsinChu (TW)

(73) Assignee: Advanced Optoelectronic Technology, Inc., Hsinchu Hsien (TW)

( * ) Notice: Subject to any disclaimer, the term of this patent is extended or adjusted under 35 U.S.C. 154(b) by 332 days.

(21) Appl. No.: 12/510,447

(22) Filed: Jul. 28, 2009

(65) Prior Publication Data

US 2010/0103658 A1 Apr. 29, 2010

(30) Foreign Application Priority Data

Oct. 24, 2008 (CN) ..... 2008 1 0305127

(51) Int. Cl.
*F21V 11/06* (2006.01)
*G09F 13/04* (2006.01)

(52) U.S. Cl. ..... 362/97.3; 362/241; 362/249.14; 362/238; 362/249.02

(58) Field of Classification Search ..... 362/545, 362/97.3, 240, 249.01, 249.02, 249.06, 249.14, 362/241, 238
See application file for complete search history.

(56) References Cited

U.S. PATENT DOCUMENTS

| | | | | |
|---|---|---|---|---|
| 1,334,779 | A * | 3/1920 | Moore | 362/240 |
| 6,488,389 | B2 * | 12/2002 | Cassarly et al. | 362/231 |
| 6,641,294 | B2 * | 11/2003 | Lefebvre | 362/544 |
| 6,783,256 | B2 * | 8/2004 | Moon | 362/241 |
| 7,641,352 | B2 * | 1/2010 | Lin et al. | 362/97.3 |
| RE41,685 | E * | 9/2010 | Feldman et al. | 362/237 |
| 7,976,210 | B2 * | 7/2011 | Shinozaki | 362/631 |
| 8,011,795 | B2 * | 9/2011 | Tien et al. | 362/97.3 |
| 8,011,802 | B2 * | 9/2011 | Hoshi | 362/244 |
| 2008/0101069 | A1 * | 5/2008 | Chang | 362/247 |
| 2009/0046446 | A1 * | 2/2009 | Kamada et al. | 362/97.3 |
| 2009/0273920 | A1 * | 11/2009 | Song et al. | 362/97.1 |
| 2010/0066944 | A1 * | 3/2010 | Mei et al. | 349/62 |

FOREIGN PATENT DOCUMENTS

| | | | |
|---|---|---|---|
| CN | 2511983 | Y | 9/2002 |
| CN | 1693962 | A | 11/2005 |
| JP | 2002-132193 | A | 5/2002 |
| JP | 2008-103200 | A | 5/2008 |

* cited by examiner

*Primary Examiner* — Ismael Negron
(74) *Attorney, Agent, or Firm* — Altis Law Group, Inc.

(57) ABSTRACT

A planar light source apparatus includes a number of lighting elements disposed in a common plane, and a number of mirror reflectors arranged perpendicular to the common plane and facing the lighting elements. The mirror reflectors each have a reflecting surface facing the lighting elements. The light elements are arranged in a lattice such that the distance from one of the reflectors to the nearest lighting element is a maximum of the half the distance between two adjacent lighting elements.

9 Claims, 14 Drawing Sheets

PLANAR LIGHT SOURCE APPARATUS HAVING REFLECTIVE SURFACES

BACKGROUND

1. Technical Field

The present disclosure relates to light sources, particularly, to a planar light source apparatus which includes a number of lighting elements therein.

2. Description of Related Art

It is known that a number of lighting elements, such as cold cathode fluorescent lamps or light emitting diodes, put in an array, can form a planar light source apparatus. Assuming that a light intensity of a light-receiving position which is spaced apart a light element with a distance D is 1 unit intensity, an overall light intensity (i.e., a light intensity of the entire planar light source apparatus which includes a number of lighting elements) of the planar light source apparatus can be more than 1 unit intensity with the same distance D.

However, light intensity measured at various light-receiving positions directly in the path of light from the planar light source apparatus can vary depending on if the light-receiving position is nearer to the central region of the planar light source apparatus or nearer to peripheral regions of the planar light source apparatus. Generally, in a light-receiving position where is nearer to a central region of the planar light source apparatus, an overall light intensity can be 1.6 unit intensity, whereas in a position where is nearer to a peripheral region of the planar light source apparatus, an overall light intensity is only 1.35 unit intensity. In this regard, if a light intensity more than 1.35 unit intensity is required, the positions where are nearer to peripheral regions of the planar light source apparatus have to be abandoned.

Increasing the density of lighting elements at the peripheral regions of the planar light source apparatus has been proposed to solve the problem above, but that becomes costly in parts needed and high power consumed.

What is needed, therefore, is a new planar light source apparatus, which can overcome the above shortcomings.

BRIEF DESCRIPTION OF THE DRAWINGS

Many aspects of the planar light source apparatus can be better understood with reference to the following drawings. The components in the drawings are not necessarily drawn to scale, the emphasis instead being placed upon clearly illustrating the principles of the present planar light source apparatus. Moreover, in the drawings, like reference numerals designate corresponding parts throughout the several views.

DETAILED DESCRIPTION OF THE EMBODIMENTS

Embodiments of the present planar light source apparatus will now be described in detail below and with reference to the drawings.

Figure 1:
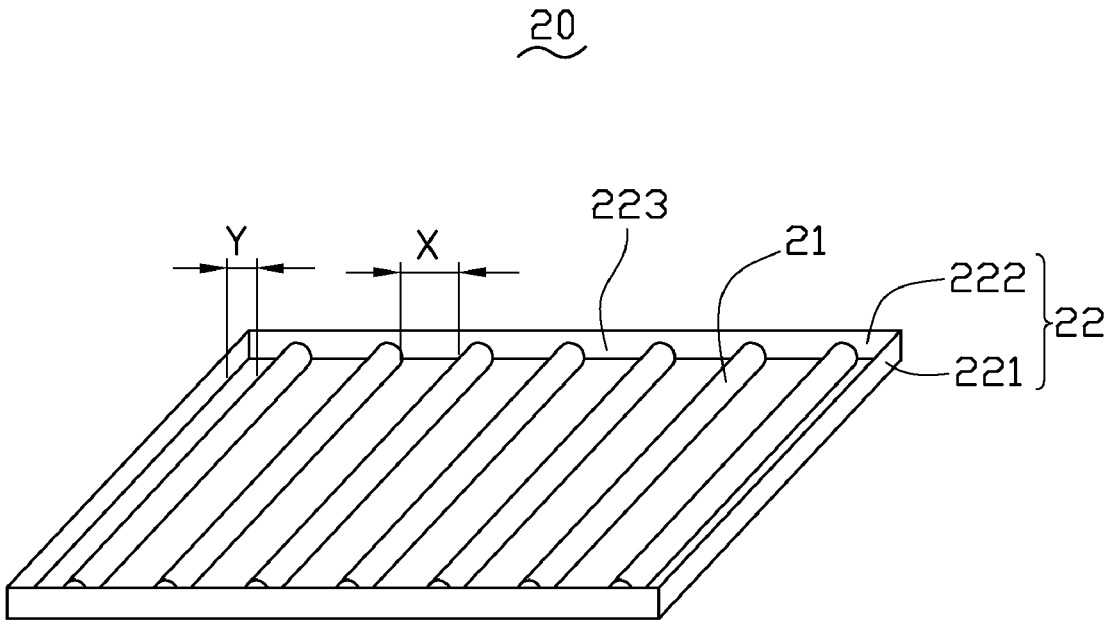
FIG. 1 is a schematic, isometric view of a planar light source apparatus in accordance with a first embodiment.

Referring to FIG. 1, an exemplary planar light source apparatus 20 in accordance with a first embodiment, is provided. The planar light source apparatus 20 is substantially rectangular, and includes a number of lighting elements 21, two first mirror reflectors 221, and two second mirror reflectors 222.

The lighting elements 21 are arranged on a same plane and equidistantly spaced from each other. The lighting elements 21 face a same direction. In the present embodiment, the lighting elements 21 are elongated shaped, and can be fluorescent lamps, cold cathode fluorescent lamps, gas discharge lamps or mercury-vapor lamps; the lighting elements 21 face the first mirror reflectors 221. Each two adjacent lighting elements 21 are a distance X apart.

Figure 2:
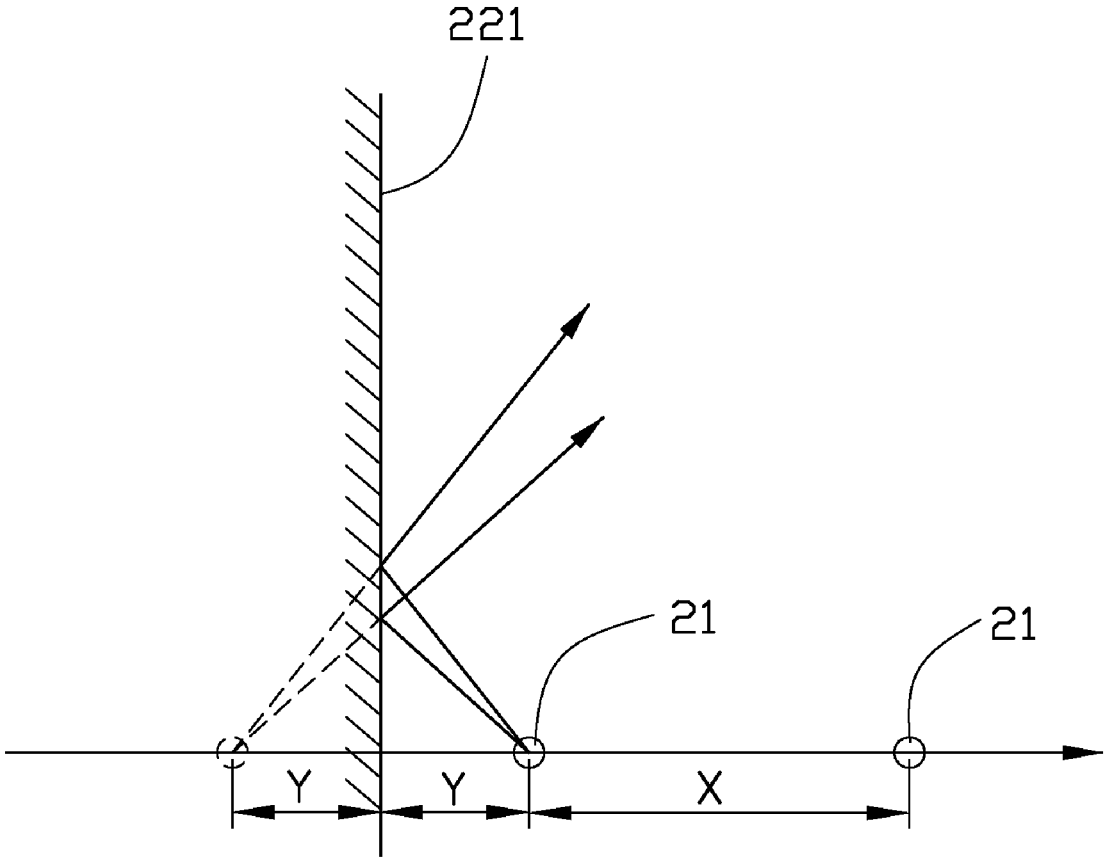
FIG. 2 is a simplified view illustrating distances X and Y shown in FIG. 1.

The first mirror reflectors 221 and the second mirror reflectors 222 are perpendicular to the plane of the lighting elements 21. The first mirror reflectors 221 and the second mirror reflectors 222 are alternately connected end to end and configured as a closed rectangular frame for the lighting elements 21. The first mirror reflectors 221 and the second mirror reflectors 222 are alike except for variations in length according to this embodiment. The first mirror reflectors 221 and the second mirror reflectors 222 each have a reflecting surface 223 facing the lighting elements 21 and perpendicular to the plane. In the present embodiment, the first mirror reflectors 221 and the second mirror reflectors 222 are metal plates, and reflectivity of each of the reflecting surfaces 223 is about 80%. The adjacent first mirror reflectors 221 and second mirror reflectors 222 form a mirror reflector unit 22. The lighting element 21 nearest to the first mirror reflector 221 has a mirror distance Y (The mirror distance Y is a distance between the first mirror reflector 221 and the nearest lighting element 21 facing thereto, or a distance between the first mirror reflector 221 and a mirror image of the lighting element 21 through the first reflector 221). The distance X and the distance Y are illustrated in FIG. 2. The distance X and the distance Y meet the condition $0 \leqq Y \leqq X$, preferably, $0 \leqq Y \leqq X/2$.

Figure 3:
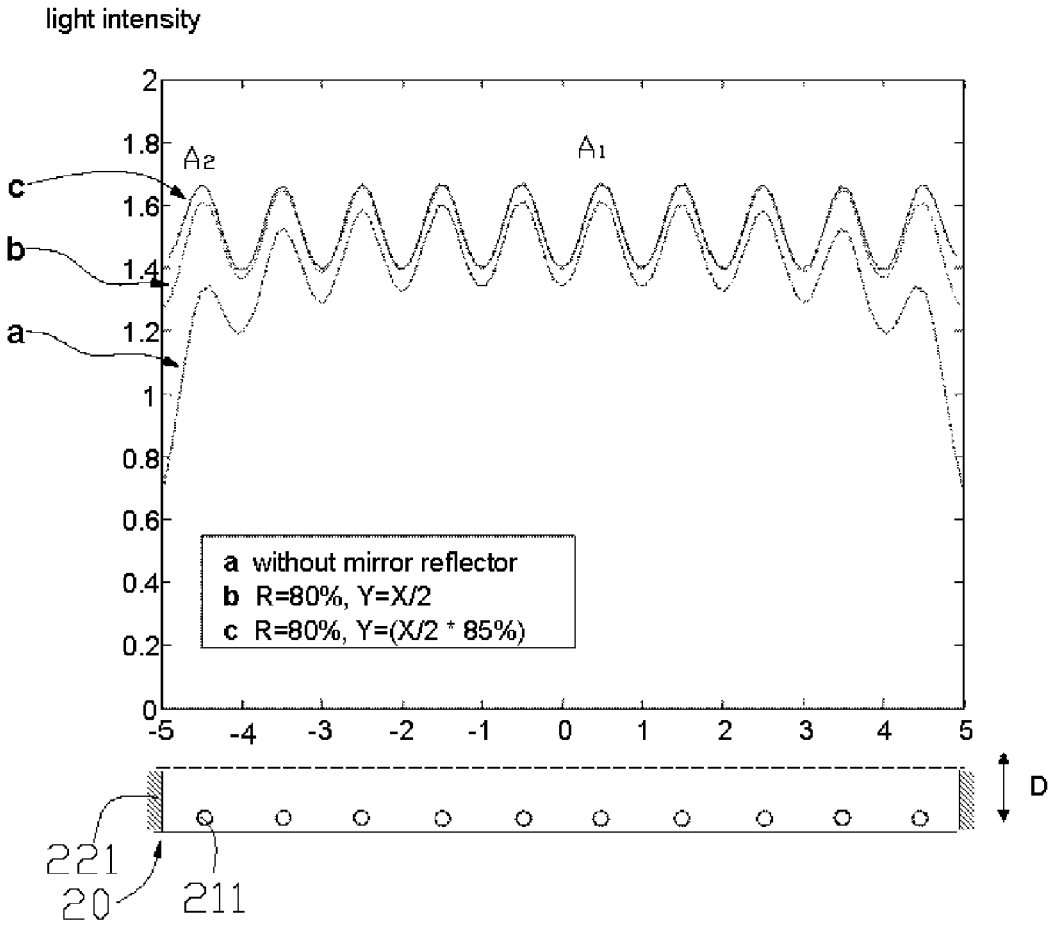
FIG. 3 is a diagram showing light intensity at a position A1 which is nearer to a central region of a planar light source apparatus and a light intensity at a position A2 which is nearer to a peripheral region of a planar light source apparatus under three conditions a, b, c.
Figure 4:
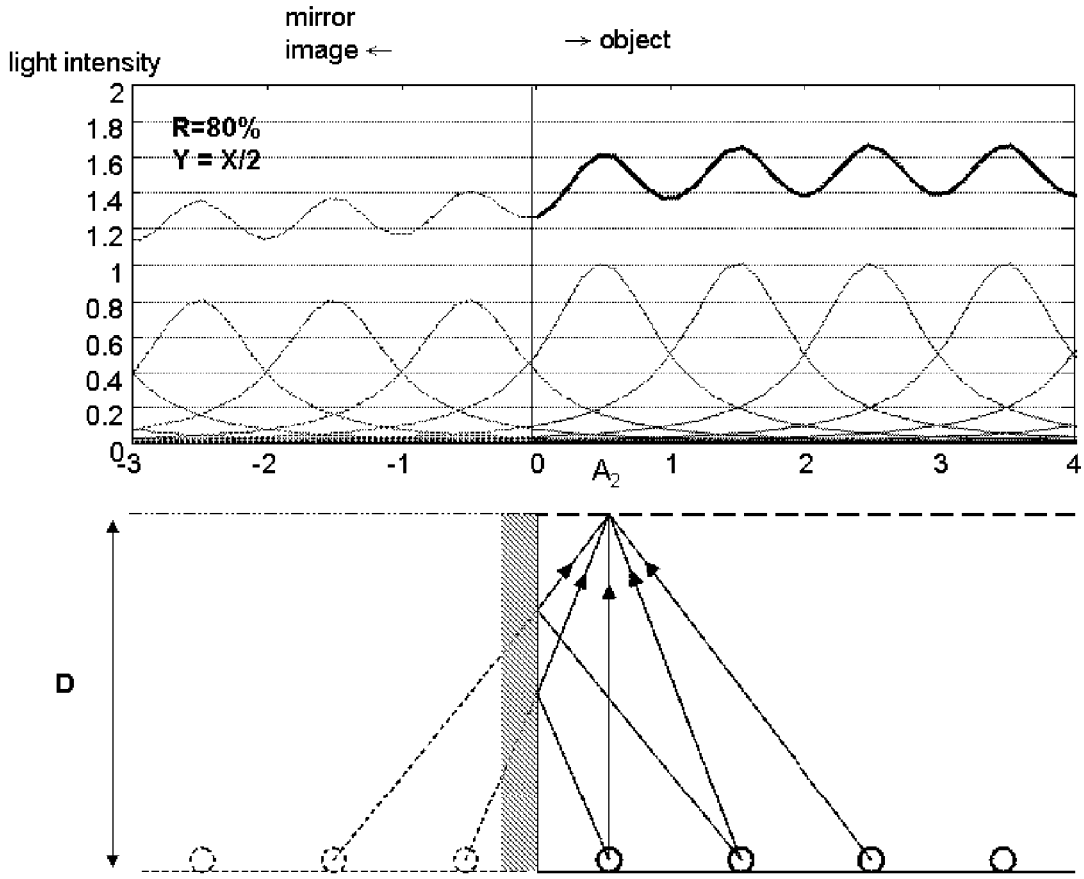
FIG. 4 is a diagram illustrating light path and light intensity at the position A2 shown in FIG. 3.

Referring to FIG. 3, the curve 'a' represents a light intensity distribution of a compared planar light source apparatus using the lighting elements 21, but without mirror reflector; the curve 'b' represents a light intensity distribution of the planar light source apparatus 20 under the condition Y=X/2; and the curve 'c' represents a light intensity distribution of the planar light source apparatus 20 under the condition Y<X/2. It can be seen that light intensity of the planar light source apparatus 20 is higher than the compared planar light source apparatus, whether measured at a position A2 above a central region of the planar light source apparatus, or at a position A1 above a peripheral region of the planar light source apparatus. Light paths along the direction D and light intensity of the position A2 are further illustrated in FIG. 4. Higher overall light intensity is achieved because the mirror reflector unit 22 compensates for lower light intensity at the peripheral regions of the planar light source apparatus 20. The smaller the distance Y is, the greater the light intensity compensation. In other words, the nearer the first mirror reflectors 221 are to the nearest light sources 21, the better the peripheral light intensity compensation.

Figure 5:
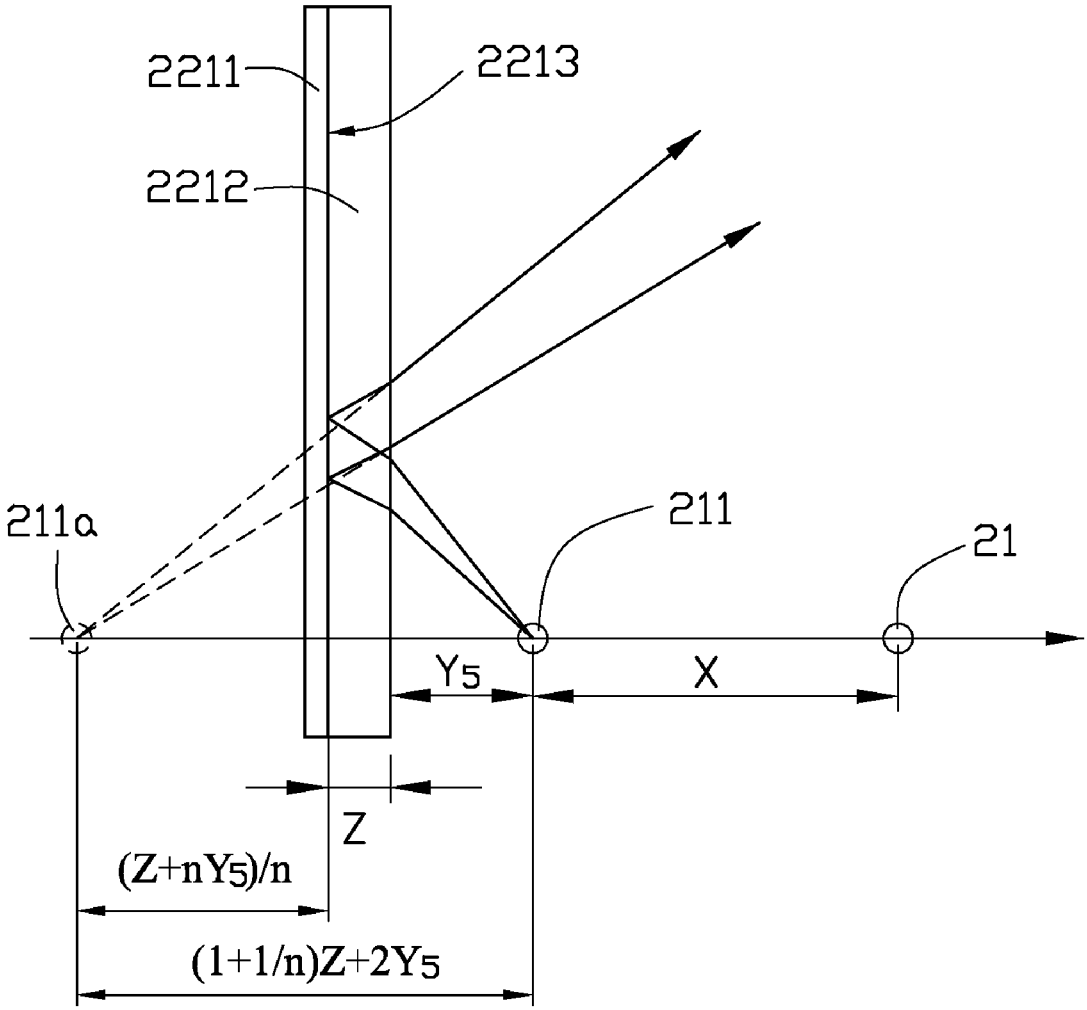
FIG. 5 is a schematic view showing a mirror reflector in accordance with an alternative embodiment.

Alternatively, referring to FIG. 5, the first mirror reflectors 221 and second mirror reflectors 222 each can be a compound structure which includes a metal base 2211 and a transparent layer 2212 formed on the metal base 2211. The metal base 2211 defines a reflecting surface 2213 facing the transparent layer 2212. The transparent layer 2212 can be made of glass, and has a refractive index n. The transparent layer 2212 has a thickness Z. The surface of the transparent layer 2212, which faces the lighting elements 21, is spaced from the nearest lighting element 211 with a distance $Y_5$. It can be calculated that the reflecting surface 2213 is spaced apart an mirror image 211*a* of a lighting element 211 with a distance $(Z+Y_5*n)/n$, and the lighting element 211 is spaced apart the mirror image 211*a* with a distance $(1+1/n)Z+2Y_5$. In such a case, the distance $Y_5$ preferably meets the condition $0 \leqq Y_5 \leqq [X-(1+1/n)Z]/2$.

Figure 6:
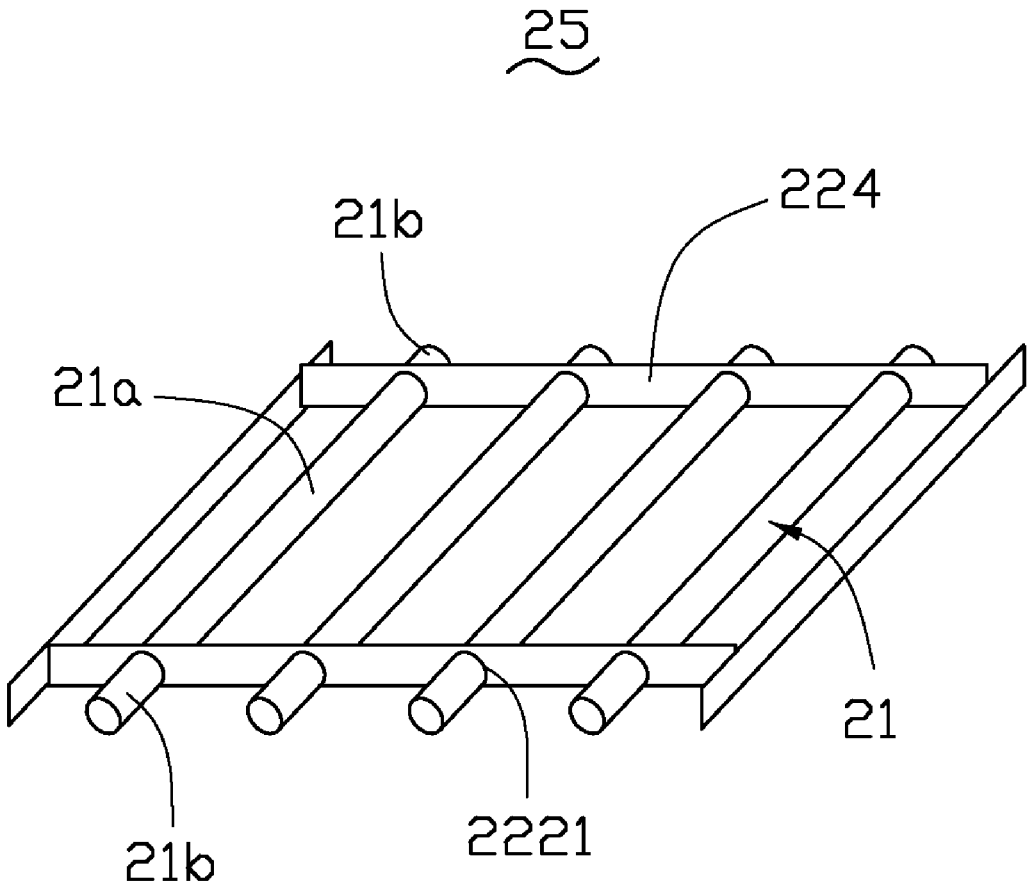
FIG. 6 is a schematic, isometric view of a planar light source apparatus in accordance with a second embodiment.

Referring to FIG. 6, an exemplary planar light source apparatus 25 in accordance with a second embodiment, is provided. The planar light source apparatus 25 is essentially similar to the planar light source apparatus 20, however, the second mirror reflectors 224 each have a number of through holes 2221 formed therein, the lighting elements 21 includes a central lighting portion 21*a* and two end portions 21*b*, the two end portions 21*b* of the lighting elements 21 extend through the respective through holes 2221. In this way, the second mirror reflectors 224 contact with the central lighting portion 21*a*, and thus the second mirror reflectors 224 contribute more to the peripheral light intensity compensation.

Figure 7:
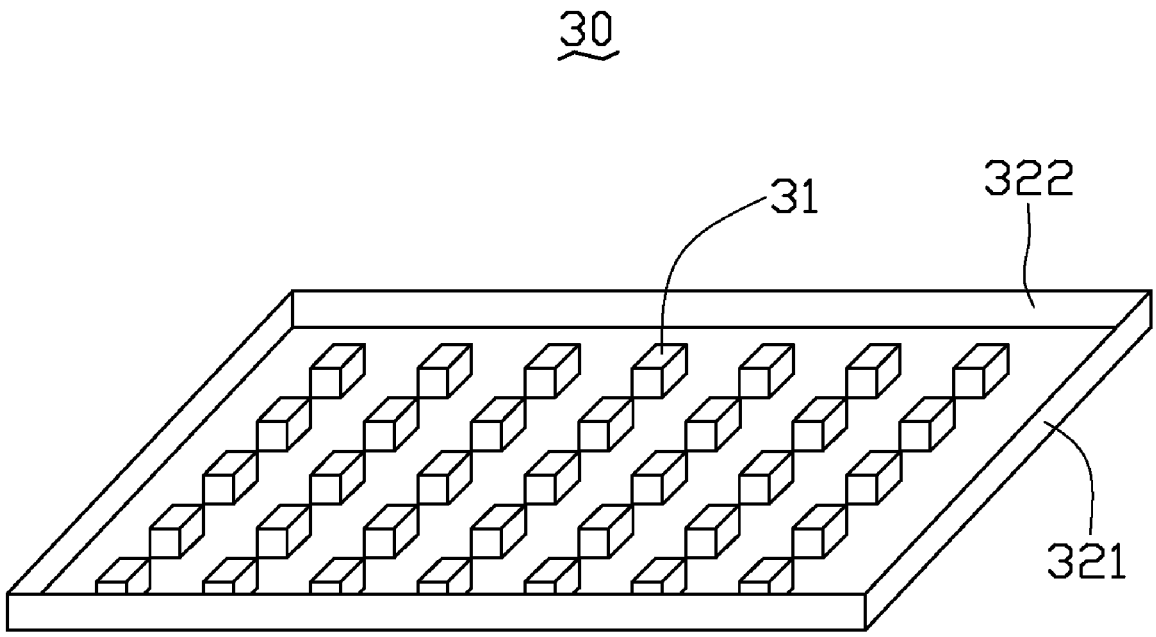
FIG. 7 is a schematic, isometric view of a planar light source apparatus in accordance with a third embodiment.
Figure 8:
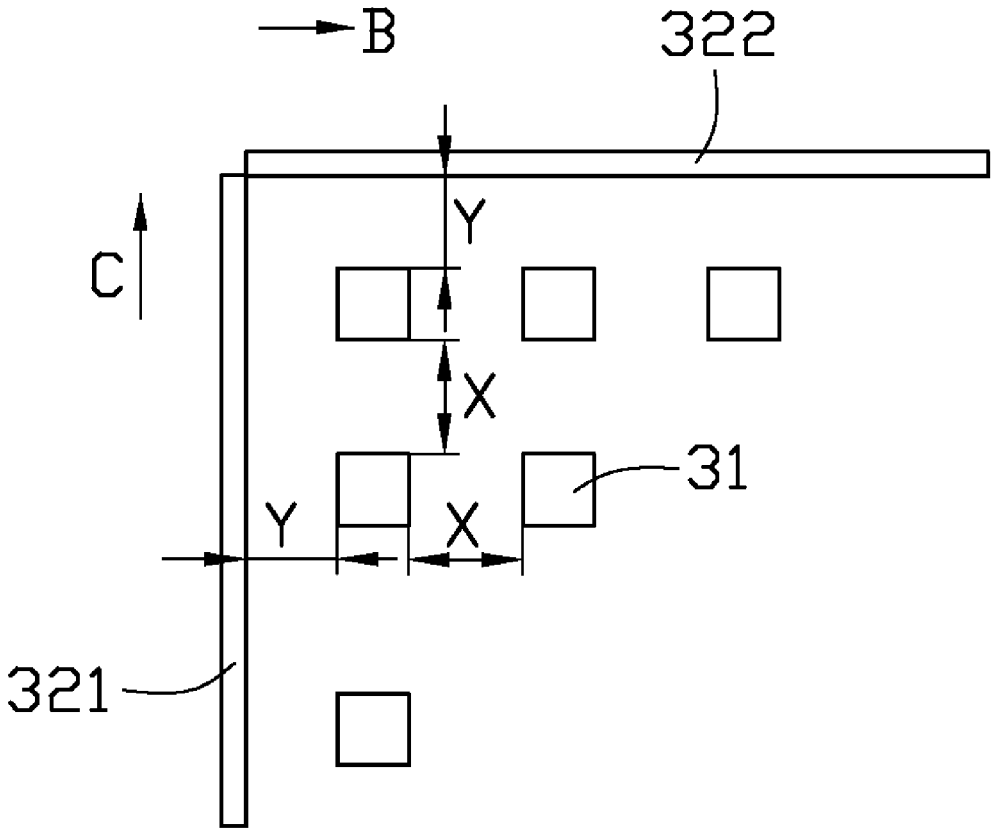
FIG. 8 is a simplified view of FIG. 7, wherein two mirror reflectors and some lighting elements are omitted.

Referring to FIGS. 7 and 8, an exemplary planar light source apparatus 30 in accordance with a third embodiment, is provided. The planar light source apparatus 30 is essentially similar to the planar light source apparatus 20. However, the lighting elements 31 are generally shaped as blocks, and are equidistantly arranged in a lattice array 10×5 along the direction B and C. The lighting elements 31 can be light emitting diodes. A mirror distance Y is maintained between the first mirror reflectors 321 and the nearest lighting elements 31 facing thereto, and is maintained between the second mirror reflectors 322 and the nearest lighting elements 31 facing thereto. The lighting elements 31 are a distance X apart. The distance Y meets the condition $0 \leqq Y \leqq X$, preferably, $0 \leqq Y \leqq X/2$ when the first mirror reflectors 321 and the second mirror reflectors 322 are metal plates. The distance Y meets the condition $0 \leqq Y \leqq [X-(1+1/n)Z]/2$ when the first mirror reflectors 321 and the second mirror reflectors 322 are configured as the compound structure shown in FIG. 5.

Figure 9:
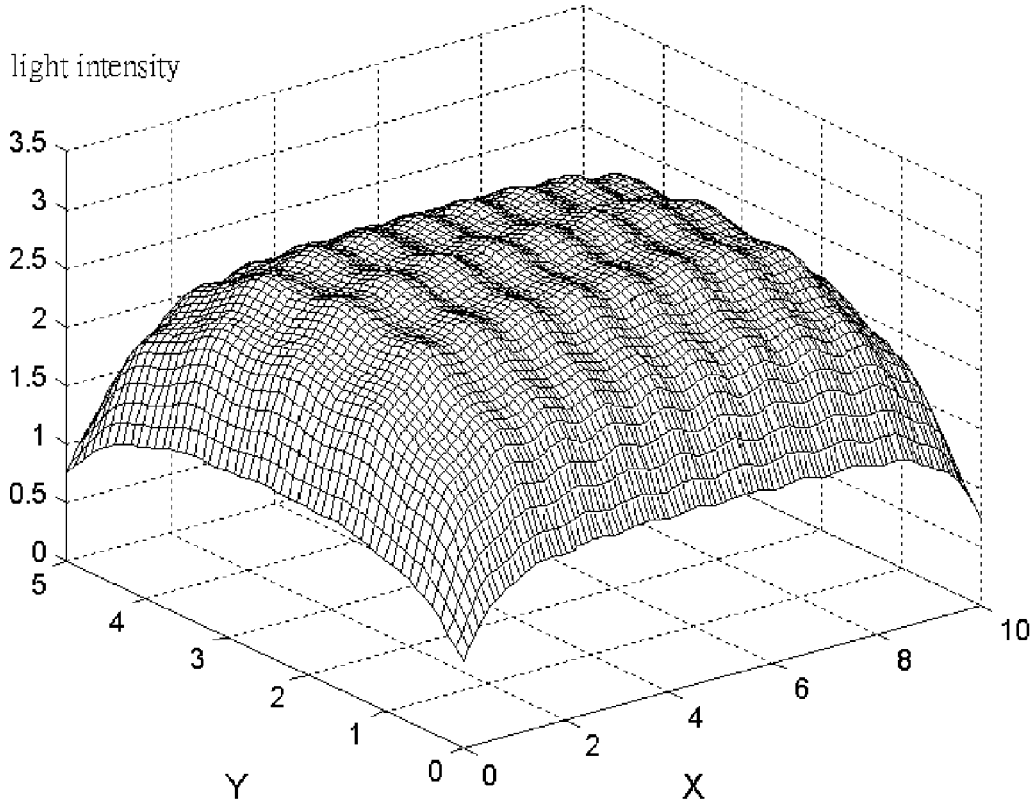
FIG. 9 is a graph of light intensity of a compared planar light source apparatus using the same lighting elements, but without mirror reflectors.
Figure 10:
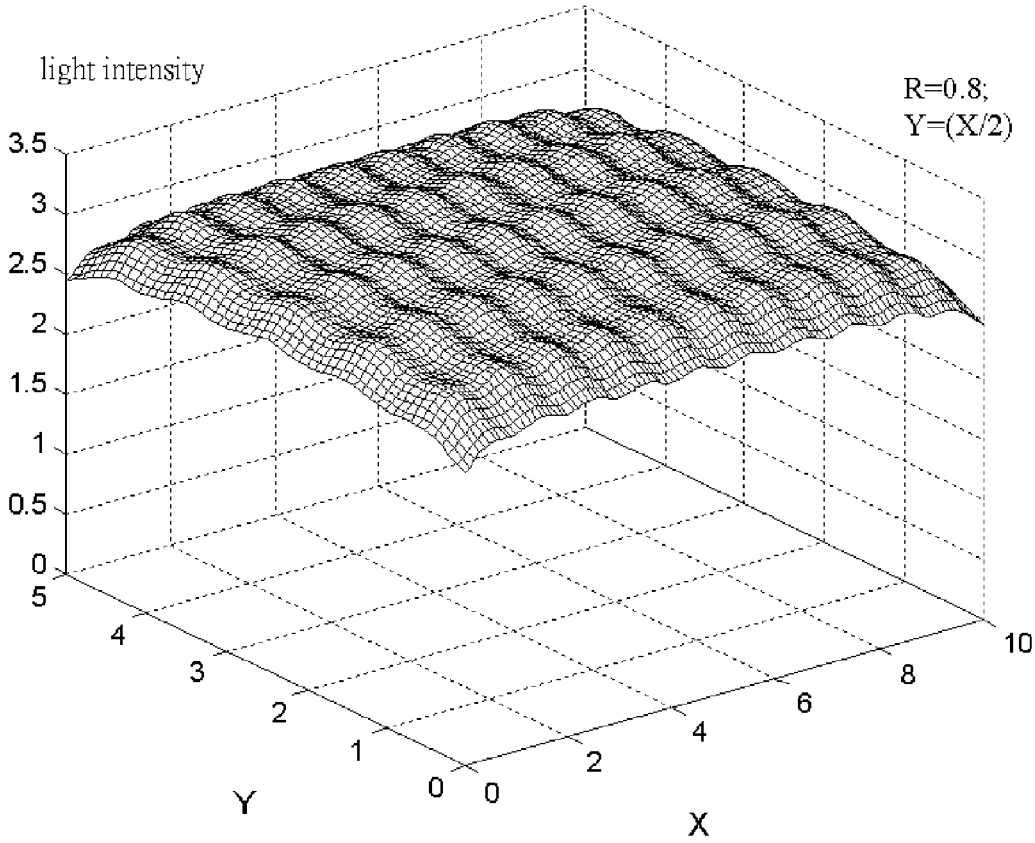
FIG. 10 is a graph of light intensity of the planar light source apparatus of FIG. 7 under the specific conditions R and Y.
Figure 11:
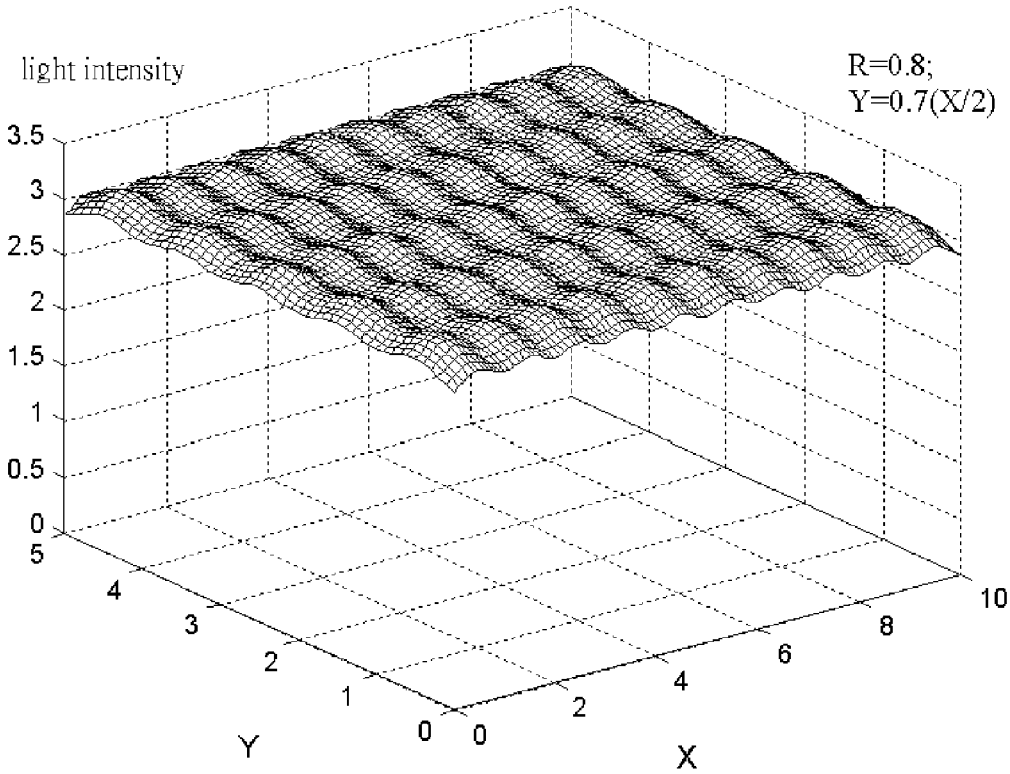
FIG. 11 is a graph of light intensity of the planar light source apparatus of FIG. 7 under another the specific conditions R and Y.

FIG. 9 shows a graph of a light intensity distribution of a compared planar light source apparatus using the lighting elements 31, but without the mirror reflector unit 22. FIG. 10 shows a graph of a light intensity distribution of the planar light source apparatus 30 under the condition Y=X/2 and the light reflectivity (R) 80% of the reflecting surfaces. FIG. 11 shows a graph of a light intensity distribution of the planar light source apparatus 30 under the condition Y=0.7(X/2) and the light reflectivity (R) 80% of the reflecting surfaces. It can be seen that light intensity difference between the central region and peripheral regions of the planar light source apparatus is smaller and smaller.

Figure 12:
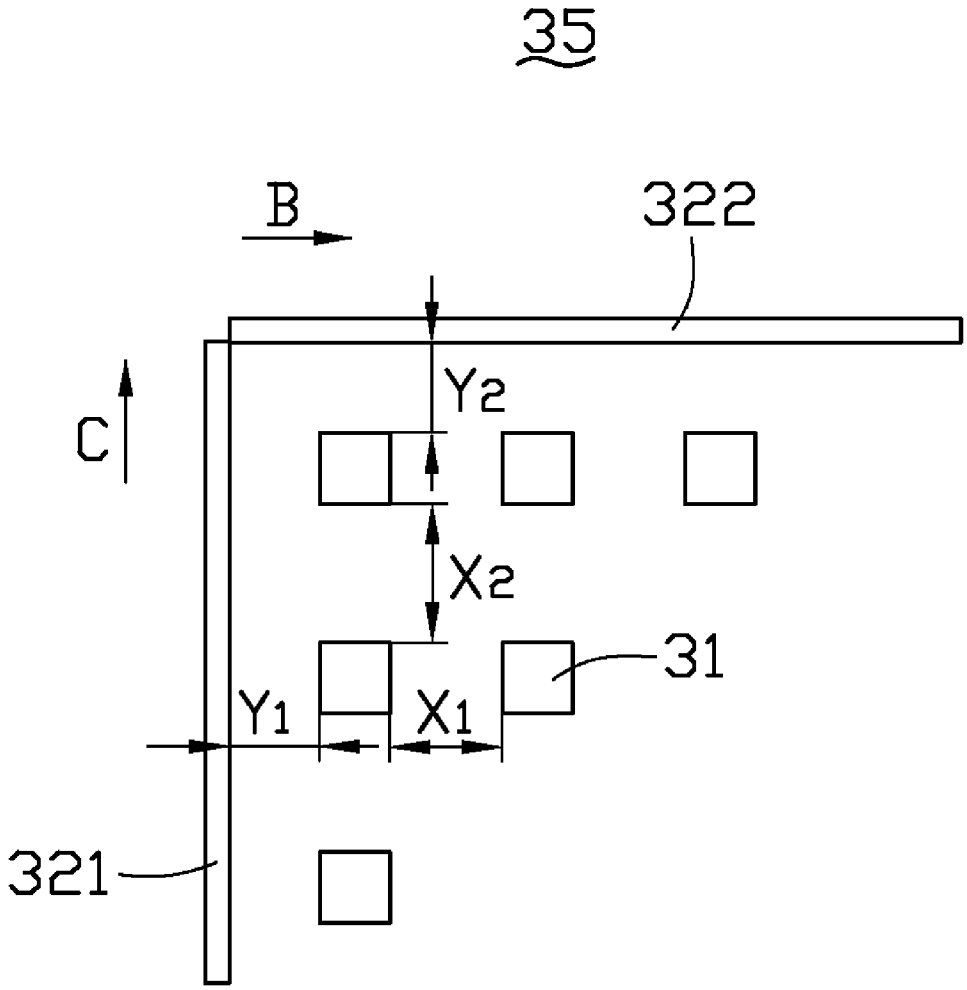
FIG. 12 is a simplified view of a planar light source apparatus in accordance with a fourth embodiment, wherein only two mirror reflectors and some lighting elements are shown.

Referring to FIG. 12, an exemplary planar light source apparatus 35 in accordance with a fourth embodiment, is provided. The planar light source apparatus 35 is essentially similar to the planar light source apparatus 30 illustrated above, however, the lighting elements 31 are arranged in an column in which the mirror distance Y, is different from the mirror distance $Y_2$, and the distance $X_1$ is different from the distance $X_2$. Wherein, the distances $Y_1$, $Y_2$, $X_1$, $X_2$ meets the condition $0 \leqq Y_1 \leqq X_1$, $0 \leqq Y_2 \leqq X_2$, preferably, $0 \leqq Y_1 \leqq X_1/2$, $0 \leqq Y_2 \leqq X_2/2$ when the first mirror reflectors 321 and the second mirror reflectors 322 are metal plate. The distances $Y_1$, $Y_2$ meet the condition $0 \leqq Y_1 \leqq [X_1-(1+1/n_1)Z_1]/2$, $0 \leqq Y_2 \leqq [X_2-(1+1/n_2)Z_2]/2$ when the first mirror reflectors 321 and the second mirror reflectors 322 are configured as the compound structure shown in FIG. 5, wherein $n_1$ and $Z_1$ represent refractivity and transparent layer thickness of the first mirror reflectors 321 along the direction C, and $n_2$ and $Z_2$ represent refractivity and transparent layer thickness of the second mirror reflectors 322 along the direction B.

Figure 13:
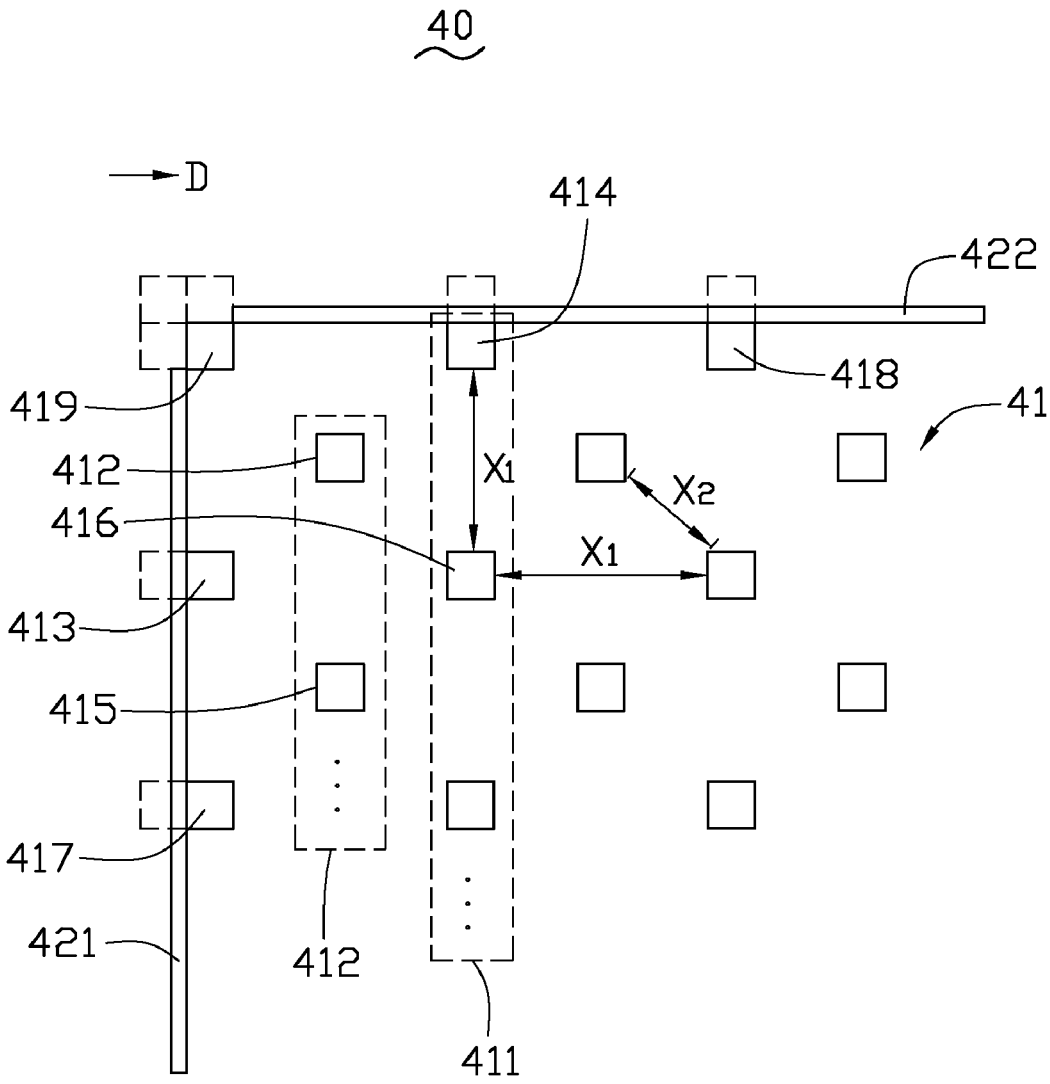
FIG. 13 is a simplified view of a planar light source apparatus in accordance with a fifth embodiment, wherein only two mirror reflectors and some lighting elements are shown.

Referring to FIG. 13, an exemplary planar light source apparatus 40 in accordance with a fifth embodiment, is provided. The planar light source apparatus 40 is essentially similar to the planar light source apparatus 30, however, the lighting elements 41 are staggered. In particular, the lighting elements 41 are distributed in a lattice array having odd columns 411 and even columns 412 along the direction D, and the lighting elements 41 in the odd columns 411 and the lighting elements 41 in the even columns 412 are staggered. Adjacent two lighting elements 41 in a same odd column 411 have a distance $X_1$, and adjacent two lighting elements 41 in adjacent odd columns 411 have a same distance $X_1$, i.e., adjacent four lighting elements 41 in adjacent two odd columns 411 cooperatively form a square lattice. Adjacent two lighting elements 41 in adjacent two odd and even columns 411, 412 have a distance $X_2$. The lighting elements 41 in the first column (i.e., the lighting elements 419, 413, 417 in FIG. 13) and the lighting elements 41 in the first one of the odd columns 411 (i.e., the lighting elements 419, 414, 418 in FIG. 13) contact the first mirror reflectors 421 and the second mirror reflectors 422, i.e., the outermost lighting elements in the lattice array contact the first mirror reflectors 421 and the second mirror reflectors 422. That is, in FIG. 13, the mirror distances illustrated as above are zero. The lighting elements 413, 414, 417, 418 each have a mirror image (see dashed line in FIG. 13) which is close to itself and has almost the same light intensity, and the lighting element 419 which is at the corner of the first mirror reflectors 421 and the second mirror reflectors 422 has three such mirror images. The mirror images extend the general light intensity of the entire planar light source apparatus 40. In such a way, adjusting a light intensity of each of the lighting elements 413, 414, 417, 418 to be 40% to 70%, preferably 50% of that of the lighting elements 412, 415, 416 which are not in the peripheries of the planar light source apparatus 40, and adjusting a light intensity of the lighting elements 419 to be 20% to 50%, preferably 25% of that of the lighting elements 412, 415, 416 can obtain a uniform light intensity for the entire planar light source apparatus 40.

Figure 14:
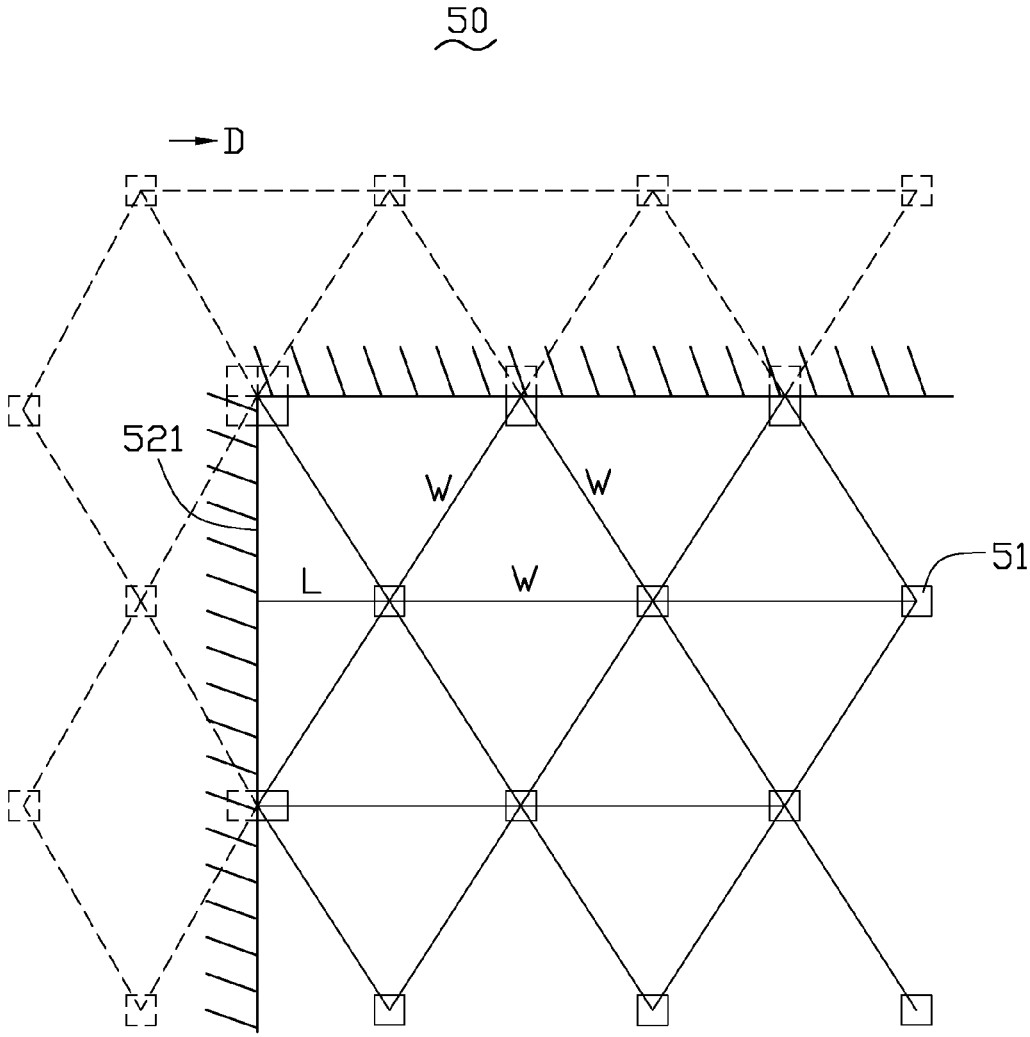
FIG. 14 is a simplified view of a planar light source apparatus in accordance with a sixth embodiment, wherein only two mirror reflectors and some lighting elements are shown.

Referring to FIG. 14, an exemplary planar light source apparatus 50 in accordance with a sixth embodiment, is provided. The planar light source apparatus 50 is essentially similar to the planar light source apparatus 40, however, adjacent three lighting elements 51 in adjacent three columns along the direction D cooperatively form a regular triangular lattice with lattice spacing W, and the distance L between the first mirror reflector 521 and the lighting elements 51 in the second column (i.e., first odd column) along the direction D is smaller than half of the lattice spacing W. The dashed line in FIG. 14 shows the mirror images of the lighting elements 51.

It is understood that in all of the embodiments of above, if the first mirror reflectors and second mirror reflectors are integrally formed into a piece, it could be recited that only one mirror reflector is needed, and the mirror reflector has a number of reflecting sections.

It is understood that the above-described embodiments are intended to illustrate rather than limit the invention. Variations may be made to the embodiments without departing from the spirit of the invention. Accordingly, it is appropriate that the appended claims be construed broadly and in a manner consistent with the scope of the invention.

What is claimed is:

1. A planar light source apparatus, comprising a plurality of lighting elements, the lighting elements being arranged on a common plane and facing a same direction; and a plurality of mirror reflectors, the mirror reflectors each having a reflecting surface facing the lighting elements, the reflecting surfaces being perpendicular to the common plane;

wherein the lighting elements are arranged in a lattice array comprising odd columns and even columns in a direction, the mirror reflectors frame the lighting elements;

wherein the mirror reflectors contact the outermost lighting elements in the lattice array; and wherein the mirror reflectors are connected end to end, a light intensity of each of the outmost lighting elements in the lattice array, which contacts only one mirror reflector, is 40% to 70% of that of the innermost lighting elements in the lattice array, and a light intensity of each of the outmost lighting elements in the lattice array, which contacts two mirror reflectors, is 20% to 50% of that of the innermost lighting elements in the lattice array.

2. The planar light source apparatus of claim 1, wherein a mirror distance is maintained between at least one of the mirror reflectors and the nearest lighting element facing thereto, and the mirror distance is less than or equal to a half distance between two adjacent lighting elements.

3. The planar light source apparatus of claim 1, wherein each of the mirror reflectors is a metal plate.

4. The planar light source apparatus of claim 1, wherein the at least one mirror reflector comprises a metal base and a transparent layer formed on the metal base, the reflecting surface is a surface of the metal base which is adjacent to the transparent layer.

5. The planar light source apparatus of claim 1, wherein the lighting elements are light emitting diodes.

6. The planar light source apparatus of claim 1, wherein the lighting elements in odd columns and the lighting elements in even columns are staggered.

7. The planar light source apparatus of claim 6, wherein four adjacent lighting elements in two adjacent odd columns cooperatively form a square lattice.

8. The planar light source apparatus of claim 6, wherein three adjacent lighting elements in three adjacent columns cooperatively form a regular triangular lattice.

9. The planar light source apparatus of claim 8, wherein a distance between at least one of the mirror reflectors and the lighting element in the first odd column is less than a half of the lattice spacing of the regular triangular lattice.

* * * * *